United States Patent [19]

Klosz

[11] 4,164,106

[45] Aug. 14, 1979

[54] SKYLIGHT

[76] Inventor: Gustav Klosz, 1112 Griffith St., Philadelphia, Pa. 19111

[21] Appl. No.: 836,263

[22] Filed: Sep. 26, 1977

[51] Int. Cl.[2] ..... E04B 7/16; E05F 17/00

[52] U.S. Cl. ..... 52/72; 49/114; 49/357; 98/29

[58] Field of Search ..... 52/1, 72, 200; 49/31, 49/104, 65, 108–114, 341, 357, 371; 98/29, 35, 61, 88 R, 96, 97, 32; 236/49; 237/46

[56] References Cited

U.S. PATENT DOCUMENTS

| | | | |
|---|---|---|---|
| 1,552,893 | 9/1925 | Sylvan | 52/72 X |
| 1,738,742 | 12/1929 | Terhune | 49/357 X |
| 1,983,521 | 12/1934 | Cooke | 98/29 X |
| 2,040,049 | 5/1936 | Kahn et al. | 98/96 X |
| 2,132,848 | 10/1938 | Feldman | 52/72 |
| 2,226,274 | 12/1940 | Winship | 49/65 |
| 2,269,488 | 1/1942 | Schwartz | 49/31 |
| 2,455,320 | 11/1948 | Stephens | 98/29 X |
| 3,350,819 | 11/1967 | Polidoro et al. | 52/72 X |
| 3,584,413 | 6/1971 | Abrami | 49/114 X |

FOREIGN PATENT DOCUMENTS

| | | | |
|---|---|---|---|
| J 7494 | 7/1956 | Fed. Rep. of Germany | 49/114 |
| 2126580 | 12/1972 | Fed. Rep. of Germany | 98/32 |
| 120291 | 9/1970 | Norway | 49/114 |

*Primary Examiner*—J. Karl Bell

*Attorney, Agent, or Firm*—Steele, Gould & Fried

[57] ABSTRACT

A double insulated, ventilating skylight for a building or the like, comprising inner and outer substantially co-extensive frames, each of the frames having at least one substantially rectangular vertical wall and an upwardly directed window panel, the vertical walls having substantially co-extensive openings therethrough. Inner and outer doors are hingeably mounted on the inner and outer frames respectively to close the openings or to provide ventilation therethrough. Means for opening and closing the inner door from within the building is provided, with linkage means connecting the outer door to the inner door so that both doors open and close simultaneously. For the purposes of insulation, means are provided for sealing the inner and outer doors against the inner and outer vertical walls when the doors are closed and insulation material substantially fills all spaces between the inner and outer frames, except where the insulation material would interfere with the ventilation or transmission of light through the window panels.

In an alternative embodiment, only the outer frame assembly and insulating material is provided, so that existing skylights may be doubly insulated as well. Linkage means are also provided for operably connecting the inner and outer doors, so that whatever means exist for operating the inner door, the outer door will be operated simultaneously therewith.

8 Claims, 4 Drawing Figures

SKYLIGHT

BACKGROUND OF THE INVENTION

1. Field of the Invention

The field of this invention relates to insulated building structures, and in particular, to insulated skylights with ventilating means. The invention provides for insulating existing skylights and for constructing new skylights.

2. Prior Art Statement

The following listed references are the closest prior art references to the subject invention of which applicant is aware: U.S. Pat. No. 3,350,819-Polidoro et al., U.S. Pat. No. 500,169-Tremmel, U.S. Pat. No. 446,824-Tousley and Swiss Pat. No. 149,023-Portmann.

With reference to FIG. 2 of Polidoro et al., there is disclosed a skylight having two simultaneously operable doors, closure plate 34, which moves in a vertical direction, and closure plate 74, pivotally connected at point 78 so that it may be opened outwardly. In contrast to the subject invention, the skylight of Polidoro et al. utilizes a very complicated linkage system, provides no indication of double walls with insulation therebetween and, as noted above, has doors which open in essentially different directions.

With respect to FIG. 4 of Tremmel, there is disclosed a double-doored cellar window, wherein both doors or sashes H and H' are pivotally mounted at their top, are parallel to one another when closed and are connected at the lower ends by pivotal linkage element L connected between points K and M. The relevant teachings of Tousley are substantially identical to the relevant teachings of Tremmel. By way of contrast, the subject invention provides double doors which are hingeably mounted at substantially different vertical points.

With reference to FIG. 1 of Portmann, there is disclosed substantially parallel, simultaneously opening doors which, while hinged at their bottoms, are hinged at somewhat different vertical points. By contrast, the outer door of the subject invention is hinged at such a distance above the inner door that an extending member is necessary to connect the hinge to the door. The extending member permits the outer door to be completely separated from the opening in the outer frame, and at the same time, serves as a shield against rain or the like entering the opening when the door is open.

With respect to the prior art in general, most existing skylights consist of a frame having two substantially triangular sides, one rectangular side, an upwardly facing, and diagonally mounted window, and ventilation means in the rectangular wall which are operable from inside the building. As a general rule, these skylights are poorly insulated, have a tendency to permit rain or the like to enter the skylight when the ventilation means are open and often leak even when the ventilation means are closed. The present invention overcomes all of these problems. In one embodiment, the subject invention is a double-framed structure, with substantially co-extensive window panels, substantially coextensive ventilating means in each frame and insulating material packed in all spaces between the frames except where the insulation would interfere with the transmission of light or ventilation. Further, means for hingeably mounting the outer door are such that the door is completely separated from the opening in the outer frame but the opening is nevertheless shielded against entry of rain or the like. In addition, the inner and outer doors which control the ventilation means are operably connected so that both may be simultaneously operated from within the building.

In a second embodiment, the outer frame and insulation are provided for attachment to existing skylights, with means for operably connecting the door of the outer frame with the existing door of the existing skylight, thereby obtaining all of the benefits and advantages noted above.

SUMMARY OF THE INVENTION

It is an object of the present invention to provide an improved insulated skylight.

It is a further object of the present invention to provide an insulated skylight with ventilation means.

It is a still further object of the present invention to provide an insulating, ventilating skylight comprising co-extensive double-frame structure with insulating material situated therebetween.

It is yet another object of the present invention to provide a double-framed insulating, ventilating skylight wherein the ventilation means of the outer frame include means for shielding the ventilation means from the undesirable elements of the weather when said ventilation means are open.

It is yet another object of the present invention to provide a shell-like structure for covering existing skylights, while at the same time maintaining and improving the operational characteristics of the existing skylight.

It is yet another object of the present invention to provide a shell-like structure for covering existing skylights, which structure has means for operably connecting ventilation means on said shell to ventilation means on said existing skylight such that said ventilation means operate simultaneously.

It is yet another object of the present invention to provide a shell-like structure for insulating existing skylights, which structure has ventilation means which prevent the entry of rain or the like through said ventilation means when said ventilation means are open.

Briefly, the subject invention is a ventilating skylight for buildings or the like, comprising inner and outer substantially co-extensive frames, each of the frames having at least one substantially rectangular vertical wall and an upwardly directed window panel, the rectangular vertical walls having substantially co-extensive openings. Inner and outer doors are hingeably mounted on the inner and outer frames respectively to control ventilation through the openings. Means are provided for opening and closing the inner door from within the building, and linkage means are provided for operably connecting the outer door to the inner door so that the doors will open and close simultaneously. Means are provided for sealing the inner and outer doors against the inner and outer vertical walls of the frames when the doors are closed. Insulation material substantially fills all of the spaces between the inner and outer frames, except where the insulation material would interfere with the ventilation or transmission of light through the window panels into the building. The outer door is hingeably mounted at the top of the skylight, by at least one extending member which not only permits the door to be completely apart from the vertical wall when in an open position, but which additionally shields the opening against the entry of rain or the like when opened.

In an alternative embodiment, the subject invention comprises a shell which is dimensioned to be substantially coextensive with and surround an existing skylight, the shell having an outer window panel substantially co-extensive with a window panel on the existing skylight and an outer opening substantially co-extensive with an opening on the existing skylight. Bracket means are provided for attaching the shell to the skylight structure. An outer door is hingeably mounted to the top of the shell for controlling ventilation through the outer opening and is connected by linkage means to the door over the opening of the existing skylight, so that both doors may be operated simultaneously. Means for sealing the outer door to the shell when the outer door is closed are provided, and insulating material substantially fills all spaces between the shell and the existing skylight, except where the insulating material would interfere with the ventilation or the transmission of light through the window panels and into the building.

BRIEF DESCRIPTION OF THE DRAWINGS

For the purpose of illustrating the invention, there are shown in the drawings forms which are presently preferred; it being understood, however, that this invention is not limited to the precise arrangements and instrumentalities shown.

DETAILED DESCRIPTION OF THE PREFERRED EMBODIMENTS

Figure 1:
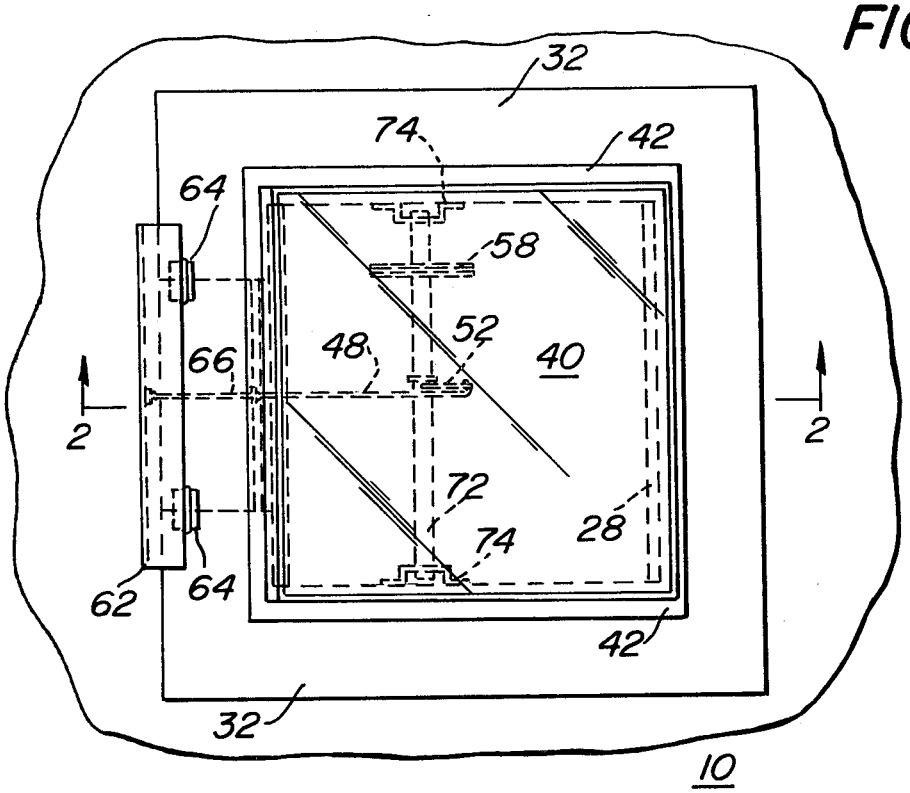
FIG. 1 is a top view of a skylight according to the present invention, with the ventilator doors closed.
Figure 4:
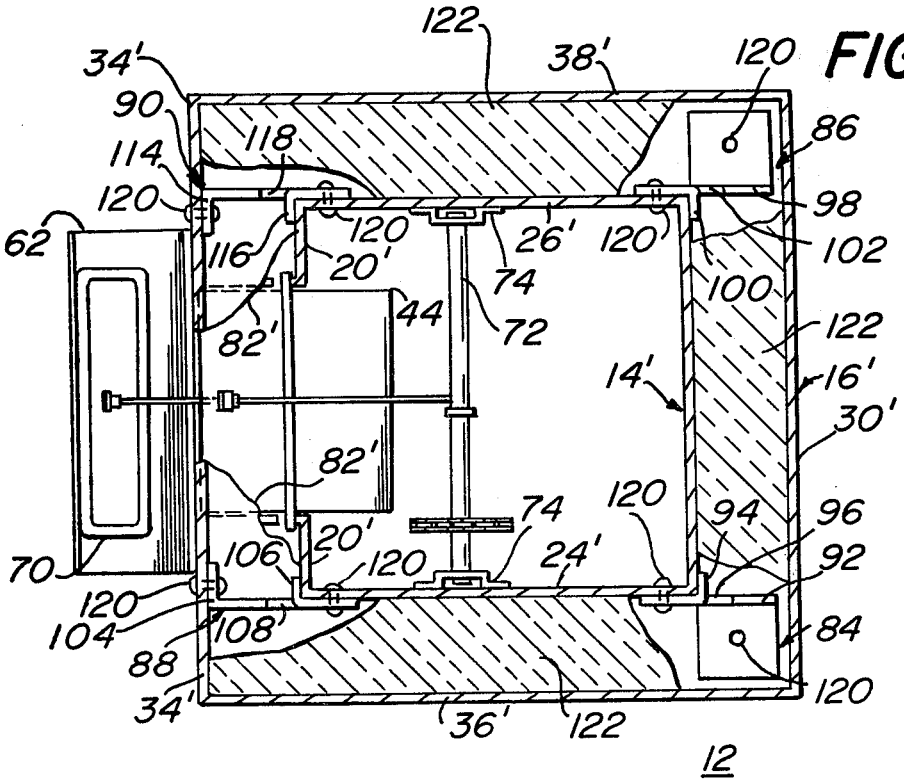

The present invention is directed to a double insulated, ventilating skylight, having two presently preferred embodiments. The first embodiments is a skylight which is originally constructed according to the teachings set forth herein. The second embodiment relates to structure which is attached to existing skylights in order to provide double insulation while maintaining ventilating capacity. In the drawings, the first embodiment, generally designated by numeral 10, is shown particularly in FIGS. 1 and 2, in which the ventilating doors of the skylight are depicted as being closed. The second embodiment, generally designated by numeral 12, is shown particularly in FIGS. 3 and 4, in which the ventilating doors are depicted as being open. Many elements in the second embodiment differ only slightly from respective elements in the first embodiment, and accordingly, are referenced by primed numerals. The completed structures of both embodiments are functional equivalents, as will become apparent. For convenience of description, and with respect to the inherent symmetry of the present invention, the references of left, right, front and rear have been applied as follows. With reference to FIG. 1, the outer ventilator door 62 is at the rear of the skylight, the side opposite the outer ventilator door is the front of the skylight, the top of the Figure is the right side and the bottom of the Figure is the left side. Therefore, with reference to FIGS. 2 and 3, the left half has been cut away. With reference to FIG. 4, the outer ventilator door 62 still defines the rear of the skylight, and in the opposite sense to FIG. 1, the right side of the skylight is at the bottom of the Figure and the left side of the skylight is at the top of the Figure.

Figure 2:
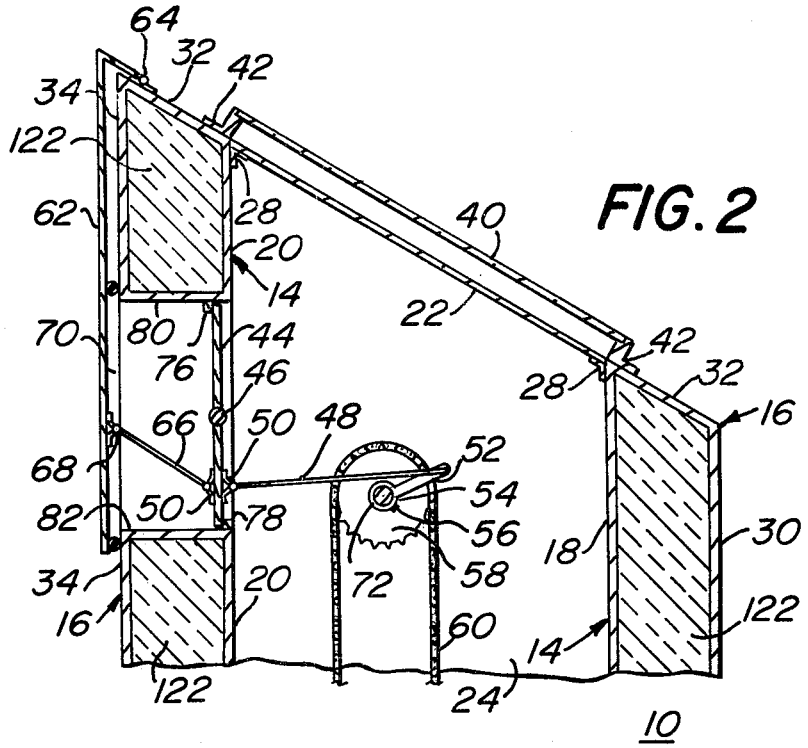
FIG. 2 is a section view of a skylight according to the present invention taken along the line 2—2 in FIG. 1.

With reference to FIGS. 1 and 2, a skylight 10 comprises an inner frame or shell 14 and an outer shell or frame 16. The inner frame 14 has a front wall 18, a rear wall 20, a right wall 24 and a left wall, not shown in FIG. 2, but shown equivalently as 26' in FIG. 4. A window 22 is supported by window braces 28.

The outer frame has front wall 30, rear wall 34, and right and left walls, not shown in FIG. 2, but shown by equivalent structure in FIG. 4 as 36' and 38' respectively. The outer frame 16 also has an upper or ceiling wall 32, in the shape of a rectangular ring, and a window 40 supported by window frame bracket 42.

Ventilation of the inner frame 14 is provided by ventilator door 44 which is pivotally mounted on door hinge rod 46. The inner ventilator door 44 is operated by the inner door actuating lever 48, which is connected to the ventilator door at one end by one of two inner door lever hinges 50, and which is connected at the other end to main locking lever 52. Main locking lever 52 is secured to axle 72 by collar 54 and set screw 56. Toothed wheel 58 is also secured to axle 72, and chain 60 is looped over toothed wheel 58 such that it engages the teeth. Pulling on either end of chain 60 will cause toothed wheel 58 to rotate, which causes axle 72 to rotate, which causes collar 54 and lock lever 52 to rotate, which finally moves inner door actuating lever 48, which actually opens and closes the inner ventilating door 44. Movement of ventilator door 44 beyond its closed position is prevented by upper door stop 76 and lower door stop 78, on which gasket material (not shown) may also be mounted.

The outer ventilator door 62 is attached to the top of the skylight structure by hinges 64. The outer ventilator door 62 is operably connected to the inner ventilator door 44 by means of the second inner door lever hinge 50, outer door actuating rod 66 and outer door lever hinge 68. The rectangular ring of gasket material 70 which may be a rubber compound, is provided for sealing the outer door 62 against the rear wall of the outer frame. Placing the hinges for the outer door at the top of the skylight provides several advantages. A first advantage is that the upper portion of the outer door 62 serves a shield against rain, snow or other such elements entering into the skylight structure. Another advantage is related to the master-slave relationship between the inner and outer ventilator doors. A comparison of the position of the ventilator doors in FIGS. 2 and 3 clearly reveals this master-slave relationship. When the inner door is caused to open, the outer door is caused to open, and vice versa. Placing the hinges 64 at a point significantly above the opening which the ventilator door covers, reduces the distance which the outer door must travel to be completely open, and decreases the force necessary to securely lock the outer door against the outer frame, as when the main locking lever 52 is in the far forward position as shown in FIG. 2.

Figure 3:
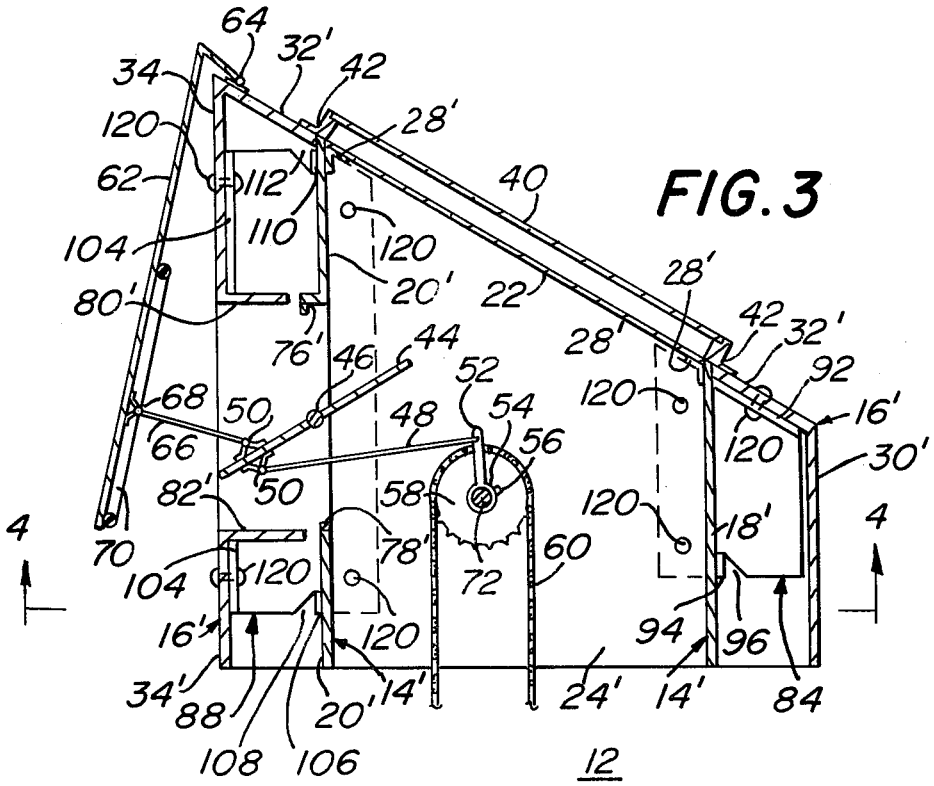
FIG. 3 is a view similar to FIG. 2, except that the ventilator doors are open and features of the second preferred embodiment are depicted therein; and, FIG. 4 is a section view taken along line 4—4 of FIG. 3

The channel through which the inner ventilator door 44 rotates, and through which air enters and leaves the skylight, is further defined by the inner door channel roof 80 and the inner door channel floor 82. In FIG. 2, which is the unitary embodiment, these elements are shown integrally with both the inner and outer frames. The particular manner in which this unitary frame structure is constructed is not particularly relevant to the principals of the present invention, and with the exception of window braces 28, no connective structure is demonstrated. With reference to FIG. 3, however, which embodies the structure added on to any existing skylight, it has been deemed necessary to demonstrate connective structure and to indicate at certain points that the structure is not unitary. This is particularly evident by inner door channel roof 80' and inner door channel floor 82', which are depicted as not quite contacting the upper door stop 76' and the lower door stop 78'. Likewise, the outer shell upper wall 32' is shown as an element separate from the inner rear wall 20' and the inner front wall 18'.

The connective structure of FIG. 3 and FIG. 4 is such as would be particularly convenient if the skylight and additional structure are constructed from sheet metal components. This is not absolutely necessary, since the various components may be wood, plastic, fiberglass or any other suitable material. Another difference between the embodiments is also demonstrated in FIGS. 2 and 3. The embodiment shown in FIG. 2 being a unitary structure, makes no particular provisions for mounting the unit to the roof, this not forming a part of this invention. The embodiment shown in FIG. 3, however, showing the "add-on" structure depicts a skylight of definite proportion, although the roof mounting structure is also omitted.

With reference to FIGS. 3 and 4, the original skylight structure 14' is comprised of front wall 18', rear wall 20', right wall 24', left wall 26', window 22, window braces 28', upper door stop 76', lower door stop 78' and identical ventilator door and ventilator door operating structure as in the embodiment of FIG. 2.

The outer shell or frame structure 16' comprises front wall 30', rear wall 34', right wall 36', left wall 38', ceiling or upper wall 32', window 40, window frame bracket 42, inner door channel roof 80', inner door channel floor 82' and the same ventilator door and operating structure as shown in the embodiment of FIG. 2.

The outer frame or shell 16' is attached to the inner frame or shell 14' by means of brackets 84, 86, 88 and 90. The right front bracket 84 has a bracket arm 92 bent at right angles to the body of the bracket, so that it is flush with the underside of the upper wall 32'. In order to facilitate construction, and in order to increase structural rigidity, an alignment tab 94 is bent upward from the body of the bracket from tab cut 96. This tab rests against the outer surface of the front wall 18'. The brackets are secured by fastening means 120, which are depicted in the drawings as rivets, but which may also be screws, nuts and bolts, adhesives or any other suitable means. Fastening means which pierce the outer shell at any point might also be provided with a grommet-like gasket or other sealing means. The left front bracket 86 is a mirror image of the right front bracket 84, and is also provided with bracket arm 98 and alignment tab 100 folded out from tab cut 102.

The right rear bracket 88 has a bracket arm 104 formed at right angles to the body of the bracket, which rests flush against the inside surface of the rear wall 34'. This bracket is provided with two alignments tabs 106 and 110, folded out from tab cuts 108 and 112 respectively. The left rear bracket 90 is a mirror image of the right rear bracket 88, and is also provided with bracket arm 114, and two alignment tabs. Only the lower alignment tab 116, folded out of tab cut 118 is shown in the drawings.

Virtually all of the space between the inner and outer frames of both embodiments is packed with thermal insulation 122, which may be styrofoam, fiberglass, or any other suitable material. This material substantially fills all of the space between the inner and outer front walls, the inner and outer right walls and the inner and outer left walls. The insulating material substantially fills all of the space between the inner and outer rear walls, except where such insulation would interfere with free movement of the inner ventilator door 44, through the channel defined by the inner door channel roof 80 or 80' and the inner door channel floor 82 or 82'. Use of additional window 40 provides the same effect as a storm window, and the window 40 may also be tinted or partially reflective to enhance its insulating effect.

The Figures demonstrate a particular mechanical arrangement for convenient operation of the ventilator doors. It will be apparent to those skilled in the art that many other suitable mechanical arrangements may be used, while still maintaining the advantage of a master-slave relationship between the inner and outer ventilator doors.

The present invention may be embodied in other specific forms without departing from the spirit or essential attributes thereof and, accordingly, reference should be made to the appended claims, rather than to the foregoing specification as indicating the scope of the invention.

I claim:

1. A ventilating structure for covering a skylight opening in a building roof or the like, comprising:

inner and outer substantially co-extensive frames forming spaced, paired walls, each of said frames having four vertical walls and a window panel secured to top edges of the inner walls, and having substantially co-extensive openings in at least one pair of said spaced walls;

inner and outer doors hingeably mounted on said at least one pair of spaced walls respectively to close said openings or to provide ventilation therethrough;

means for opening and closing said inner door from within said building;

linkage means for operably connecting said outer door to said inner door, so that said doors open together and close together;

means for sealing said inner and outer doors against said at least one pair of spaced walls when said doors are closed; and, insulation substantially filling all spaces between said inner and outer frames, except between said openings and between said window panels.

2. The skylight of claim 1 further comprising at least one extending member for hingably mounting said outer door at the top of said structure, thereby permitting said outer door to be completely apart from said outer opening when said doors are open.

3. The skylight of claim 1, wherein said outer window panel is at least partially light reflective.

4. The skylight of claim 1, wherein said inner door is hingeably mounted along its central longitudinal axis.

5. The skylight of claim 1, wherein said opening and closing means comprise:

a rotatable shaft mounted substantially parallel to and somewhat below the axis of rotation of said inner door;

a pulley fixably mounted to said shaft, said pulley having a peripheral toothed track;

a lever arm fixably mounted to said shaft;

pivotal linkage means connecting one end of said lever arm to a point on the inside lower surface of said inner door; and chain-like cable means looped around and in engagement with said peripheral track, said cable means having ends which extend downwardly from said skylight into said building.

6. The apparatus of claim 1, wherein said frames are sheet metal.

7. The apparatus of claim 1, wherein said claims are molded members.

8. The apparatus of claim 7 wherein said frames are fiberglass.

* * * * *